United States Patent [19]

Agajanian

[11] 4,123,080

[45] Oct. 31, 1978

[54] SKATEBOARD

[76] Inventor: Christopher J. Agajanian, 217 Eleventh St., Manhattan Beach, Calif. 90266

[21] Appl. No.: 799,545

[22] Filed: May 23, 1977

[51] Int. Cl.[2] ..... B62M 1/00

[52] U.S. Cl. ..... 280/87.04 A; 280/11.28

[58] Field of Search ..... 280/87.04 A, 87.04 R, 280/11.1 BT, 11.27, 11.28, 11.14

[56] References Cited

U.S. PATENT DOCUMENTS

| | | | |
|---|---|---|---|
| 304,949 | 9/1884 | Mitchell | 280/11.28 X |
| 865,441 | 9/1907 | Slocum | 280/11.28 |
| 2,330,147 | 9/1943 | Rodriquez | 280/87.04 R |
| 3,795,409 | 3/1974 | Cudmore | 280/87.04 A |

*Primary Examiner*—John A. Pekar

*Attorney, Agent, or Firm*—Lyon & Lyon

[57] ABSTRACT

A skateboard comprising a platform upon which a rider stands, a front wheel assembly, a back wheel assembly and means interposed between said platform and said wheel assemblies to provide for an improved riding performance.

7 Claims, 5 Drawing Figures

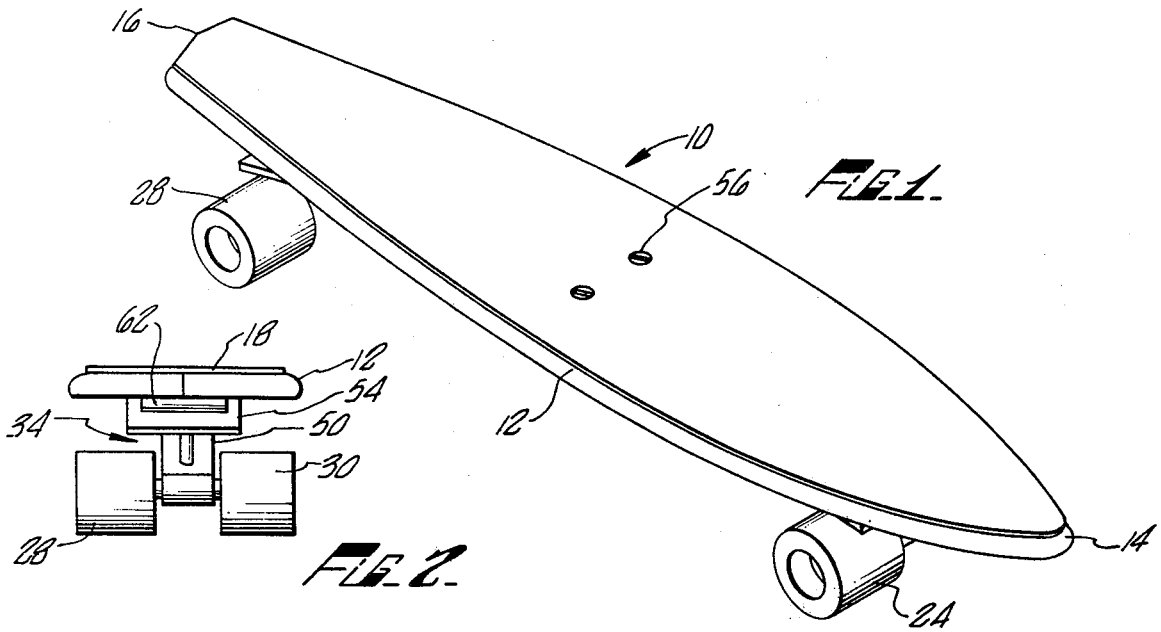
FIG. 1
FIG. 2
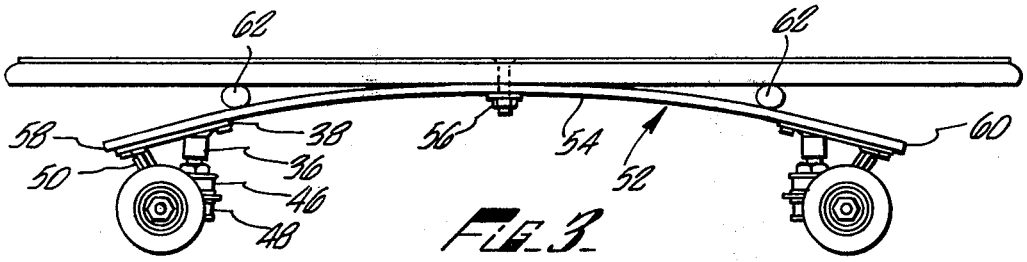
FIG. 3
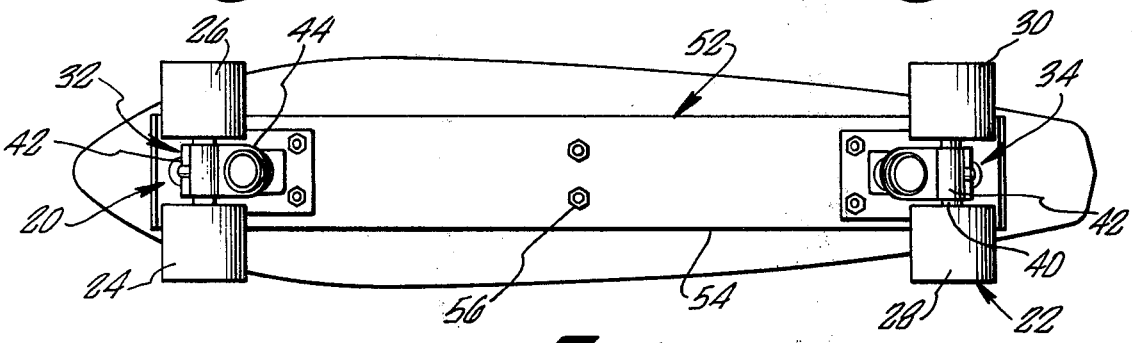
FIG. 4
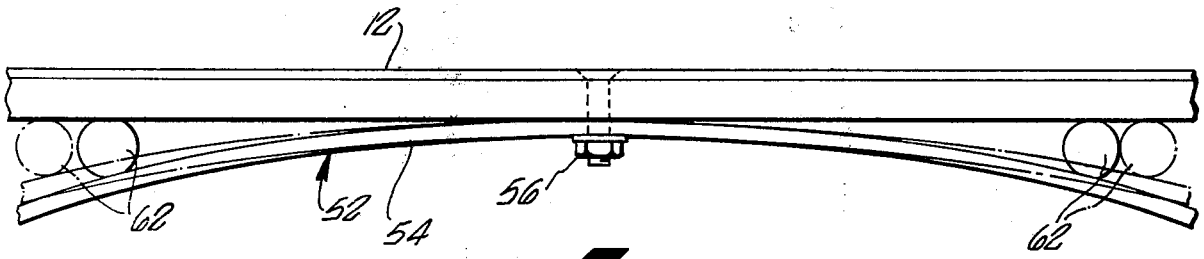
FIG. 5

SKATEBOARD

BACKGROUND OF THE INVENTION

This invention relates to a skateboard and more particularly to a skateboard which provides for a generally improved riding performance.

Skateboarding is an increasingly popular sport. In its early stages, about twenty or more years ago, the skateboards were rather crude devices generally comprising the front and back wheels of a rollerskate attached to a stiff board. These crude devices lacked stability, had limited maneuverability and were generally dangerous. Thus, a rider was very limited in what he could do during a ride and had to be extremely cautious in riding the skateboard in order to avoid an accident. As a result, interest in the sport of skateboarding waned.

This interest was rejuvenated however with the advent of certain improvements in the skateboards. The principal improvements involved the use of polyurethane wheels which provided for greater control and stability and the use of journaled assemblies or so-called trucks to connect the wheels to the board which increased the turning capacity of the skateboard. Another improvement involved the use of a more flexible board upon which the rider stood.

As a result of the improvements to the skateboard device, not only did interest in the sport increase substantially, but performances by the participants improved and expanded and became very refined. For example, even the non-competitive rider is able to ride down steep hills, turn sharply and make jumps. The more experienced and competitive riders can do even more. They ride at high speeds, traverse steep bowls and obstacle courses, make jumps were they jumb off the board over an obstacle and then land back on the skateboard, and, on occasion, they even ride in a hand stand fashion on the board.

However, with the increased interest and the increased competition, a strong desire developed for a skateboard with improved performance characteristics which will provide an improved ride not only for the average rider but also for the competitive rider. The present invention is directed to the satisfaction of this desire.

Thus, it is a principal object of the present invention to provide a skateboard which provides for greater control, increased riding comfort and better maneuverability than the skateboards heretofore used. These and other objects are met by the present invention which briefly includes a flat platform on which a rider stands or otherwise rides, front and back wheel assemblies each of which comprises a pair of wheels and a truck and suspension means which flexibly mount the wheel assemblies to the platform. Such means also permit adjustment in the degree of flexibility between the wheel assemblies and the platform and adjustment of the mounting position of the trucks relative to the platform surface.

Another important object of the present invention is to provide a skateboard which can be propelled by the rider while both of the rider's feet remain on the platform with better results than the heretofore used skateboards. Still another object is to provide a skateboard which can be turned easily and quickly. A still further object of the present invention is to provide a skateboard having improved performance characteristics which is relatively economical to manufacture. These above objects as well as other objects and advantages of the present invention will be made readily apparent from the accompanying drawings and following detailed description of the invention.

Referring now to the drawings:

FIG. 1 is a top perspective view illustrating in particular the riding surface of the platform of the skateboard;

FIG. 2 is a rear end view of the skateboard;

FIG. 3 is a side view of the skateboard illustrating the mounting relationship of the wheel assemblies with respect to the platform;

FIG. 4 is a bottom view of the skateboard; and

FIG. 5 is an enlarged partial side view illustrating the adjustability of the skateboard of the present invention.

In describing the present invention in detail reference is first made to FIGS. 1 and 4. The skateboard, generally designated 10, includes a platform 12 which is in the form of a flat board which is generally wider in the mid-section than at its front end 14 and back end 16. The riding surfaces 18 of the platform 12 upon which a rider stands or otherwide rides is flat and large enough to permit a rider to have both feet on the surface at the same time. The platform may be made of wood, plastic or metal, but should be of sufficient strength to carry, without breaking or excessively bending, an average adult male. However, it should be noted that the skateboard may be made in various sizes to accomodate various size individuals.

The skateboard 10 also includes both a front wheel assembly, generally designated 20, and a rear wheel assembly, generally designated 22. The front and back wheel assemblies 20 and 22 each include, respectively, a pair of cylindrically shaped wheels 24 and 26 and 28 and 30 and mounting means or trucks, generally designated 32 and 34. The wheels are conventional polyurethane wheels and while such conventional wheels may vary slightly they are all substantially similar to wheels manufactured by O. J. Wheels, 825 41 Ave., Santa Cruz, Ca.

The trucks are also conventional and well known to those skilled in the art. A typical such truck is manufactured by Bernard Tool and Manufacturing Company, whose address is Downey, Ca. Such trucks incude a mounting post 36 rigidly secured to a mounting plate 38. The axis 40 of the wheels is connected to the mounting post 36 by a collar member 42, an integral flange 44 of which is secured to the post 36 between a pair of rubber or otherwise flexible washers 46 and 48. These washers 46 and 48 and the flange 44 permit limited rotational movement of the wheels in a horizontal plane about the post 36 and also vertical up and down movement of the wheels. Another integral flange 50 pivotally connects the wheel axis 40 to the mounting plate 38.

Because of the wheels and the manner in which they are mounted by the trucks, a rider during riding can turn the skateboard by merely shifting his weight to one side of the platform. That is, if the rider desires to turn left the rider shifts the weight to the left side of the platform and this causes the front wheels, as viewed from above, to rotate counter-clockwise a few degrees in the horizontal plane and the back wheels to simultaneously rotate clockwise a few degrees in the horizontal plane. A shift of the weight to the right side of the platform causes the front and back wheels, respectively, to rotate in an opposite direction.

Suspension means, generally designated 52, is interposed between the platform 12 and the wheel assemblies 20 and 22. The suspension means 52 includes an elongated plate member 54 of generally rectangular form.

This plate member 54 is flexible and preferably comprises of a pultruded fiber reinforced plastic plank such as that sold by Glastrusion Inc., 2675 Skypark Drive, Torrance, Ca.

The plate member 54 is arranged underneath the platform 12 with its lengthwide axis substantially parallel to and common with the lengthwise axis of the platform 12. At substantially its midpoint the plate member 54 is secured to the platform 12 by means such as nut and bolts 56. Such securement allows the ends 58 and 60 of the plate member 54 to flex.

Attached proximate the front end 58 of plate member 54 is the mounting plate 38 of the front wheel assembly 20. Attached proximate the back end 60 of the plate member 54 is the mounting plate 38 of the back wheel assembly 22.

Biasing means 62, preferably in the form of cylindrical rods about ¾ inch or 1.9 cm in diameter and 3 inches or 7.62 cm in length, are wedged on each side of the midpoint of plate member 54 between the plate member 54 and the underside surface of the platform 12. The biasing means 62 are preferably rubber, but other elastic and resilient materials may also be employed. Other shapes including shapes which are square, rectangular or triangular in cross-section may also be used for the biasing means 62. The biasing means 62 bias each end portion of the plate member 54 away from the underside of the platform 12 and also act as a cushion between the wheel assemblies and the platform.

During a ride the ends of the plate member 54 and thus the wheels are biased from the underside of the platform 12. The biasing means 62 and the flexing of the plate member 54 permits movement of the wheel assemblies to and away from the underside surface of the platform during riding of the skateboard and thereby absorbs shocks caused by jumping or going over bumps. The ride is, in effect, cushioned. Thus, the skateboard of the present invention provides for a smoother, more comfortable ride and also a more stable ride which allows for better control of the skateboard by the rider.

Another feature of the present invention relates to the manner in which the skateboard can be propelled by the rider. Because of the flex or spring created by the biased plate member 54, a rider can, by pumping, propel the skateboard without the rider's feet leaving the platform. The pumping, in essence, involves pushing with the feet on the skateboard to cause it to turn in one direction and then pushing to cause it to turn in the other direction and continuously repeating the process. Because of the flex characteristics of the skateboard of the present invention, the results of such self-propelling are significantly better than with conventional skateboards.

Still another feature of the present invention involves the turning performance of the skateboard. As illustrated by FIG. 3, the biasing of the plate member 54 and thus the suspension of the trucks and wheels changes the angle in which the trucks are normally mounted with respect to the platform 12. That is, in normal mounting the mounting plates 38 of the trucks are flat with the underside surface of the platform. In the present invention the mounting plates 38 are not flat nor parallel with the underside surface of the platform 12 and thus the position of the mounting post 36 and pivot flange 50 are also changed with respect to the platform. It is felt that this change aids in the making of fast and sharp turns by a rider. This feature has particular significance to riders competing in contests, but is also important to the average rider.

Another significant feature of the present invention is illustrated by FIG. 5. Because the biasing means 62 are not connected to either the platform 12 or the plate member 54, their position with respect to the lengthwise axis of the skateboard may be adjusted. However, once positioned, the biasing means 62 will remain in a fixed position during the ride as a result of the pressure applied on the biasing means by the flexed plate member 54. This adjustment feature permits a rider to control the degree of cushioning desired during a ride. That is, it varies the amount of resistance to movement of the wheel assemblies relative to the underside of the platform. It also permits the rider to adjust the position of the trucks with respect to the platform and thereby provides control for turning of the skateboard.

Having fully described my invention, it is to be understood that I do not wish to be limited to the details of the embodiments herein set forth or to the details illustrated in the drawings, but my invention is of the full scope of the appended claims.

I claim:

1. A skateboard comprising:

a platform having a front end, a back end a lengthwise axis, an underside surface and an upper surface for accomodating the feet of a rider during the riding of the skateboard;

a front wheel assembly positioned under the plane of said platform and proximate said front end thereof;

a back wheel assembly positioned under the plane of said platform and proximate said back end thereof;

suspension means interposed between said platform and said wheel assemblies, said suspension means including biasing means and an elongated flexible member secured generally at its mid-section to said platform and substantially midway between said ends and extending in a direction substantially parallel to said lengthwise axis of said platform; said elongated member having at its ends said front and back wheel assemblies secured thereto with the ends of said elongated member biased from said underside surface of said platform; said biasing means biasing the ends of said elongated member and positioned between said elongated member and said underside surface, said biasing means permitting movement of the ends of said elongated member toward and away from said underside surface of said platform during riding of the skateboard.

2. The skateboard of claim 1, wherein said elongated member comprised a flat substantially rectangular plate.

3. The skateboard of claim 2, wherein said elongated member is comprised of pultruded fiber reinforced plastic.

4. The skateboard of claim 1, wherein said biasing means comprises a pair of biasing members, with one of said biasing members on each side of the secured mid-section of said elongated member and with each said biasing member being movable between said secured mid-section of said elongated member and an end of said platform to vary the resistance to movement of said elongated member relative to said underside surface of said platform.

5. A skateboard comprising:

a platform having a front end, a back end, a lengthwise axis, an underside surface and an upper surface for accommodating the feet of a rider during the riding of the skateboard;

a front wheel assembly positioned under the plane of said platform and proximate said front end thereof;

a back wheel assembly positioned under the plane of said platform and proximate said back end thereof;

suspension means interposed between said platform and said wheel assemblies, said suspension means including biasing means and an elongated flexible member secured generally at its mid-section to said platform and substantially midway between said ends and extending in a direction substantially parallel to said lengthwise axis of said platform, said biasing means comprising cylindrical rods, with one of said rods on each side of the secured mid-section of said elongated member, said elongated member having at its ends said front and back wheel assemblies secured thereto with the ends of said elongated member biased from said underside surface of said platform; said biasing means biasing the ends of said elongated member and positioned between said elongated member and said underside surface, said biasing means permitting movement of the ends of said elongated member toward and away from said underside surface of said platform during riding of the skateboard.

6. The skateboard of claim 5, wherein said rods are comprised of rubber.

7. The skateboard of claim 5, wherein each said rod is movable between said secured mid-section of said elongated member and an end of said platform to vary the resistance to movement of said elongated member relative to said underside surface of said platform.

* * * * *